US007617667B2

(12) United States Patent
Jerome, Jr.

(10) Patent No.: US 7,617,667 B2
(45) Date of Patent: Nov. 17, 2009

(54) TREATMENT OF BRITTLE, HIGH-MODULUS YARNS TO YIELD IMPROVED PROCESSING CHARACTERISTICS

(75) Inventor: Manuel R. Jerome, Jr., New Bedford, MA (US)

(73) Assignee: Pascale Industries, Inc., Pine Bluff, AK (US)

( * ) Notice: Subject to any disclaimer, the term of this patent is extended or adjusted under 35 U.S.C. 154(b) by 712 days.

(21) Appl. No.: 11/314,245

(22) Filed: Dec. 22, 2005

(65) Prior Publication Data

US 2007/0148454 A1 Jun. 28, 2007

(51) Int. Cl.
*D02G 3/22* (2006.01)

(52) U.S. Cl. ..... 57/229; 57/232

(58) Field of Classification Search ..... 57/210, 57/229, 232

See application file for complete search history.

(56) References Cited

U.S. PATENT DOCUMENTS 3,857,229 A * 12/1974 Marzocchi ..... 57/229
4,375,779 A * 3/1983 Fischer ..... 87/6
4,708,080 A 11/1987 Conrad
4,967,548 A * 11/1990 Fangeat et al. ..... 57/224
5,727,357 A * 3/1998 Arumugasaamy et al. ..... 52/834
7,080,500 B2 * 7/2006 Akiyama et al. ..... 57/212
7,121,077 B2 * 10/2006 Andrews et al. ..... 57/210

* cited by examiner

*Primary Examiner*—Shaun R Hurley
(74) *Attorney, Agent, or Firm*—Michael de Angeli

(57) ABSTRACT

Multifilamentary core yarns of brittle, high-modulus materials are partially encased in a "wrapper" of another material. The wrapped core yarn is then coated with an adhesive that remains tacky over time. The coated wrapped yarn can then be spooled and stored indefinitely; when it is desired to be used, the yarn can be pulled off the spool without "blocking", that is, the presence of the wrapper precludes damage to the brittle filaments of the core yarn caused by filaments of adjacent strands of the yarn adhering to one another. The tacky surface allows the yarn to be disposed where desired against a substrate, and heat and pressure to be applied to ensure that it will remain in position. Various processes previously not feasible with brittle, high-modulus multifilamentary yarns can be practiced.

5 Claims, 3 Drawing Sheets

TREATMENT OF BRITTLE, HIGH-MODULUS YARNS TO YIELD IMPROVED PROCESSING CHARACTERISTICS

FIELD OF THE INVENTION

This invention relates to treatment of brittle "high-modulus" yarns, that is, elongated multifilamentary members exhibiting high ratios of stress to strain, so as to substantially improve their processing characteristics, to yarns thus treated, and to products manufactured using such yarns.

BACKGROUND OF THE INVENTION

There are many applications in which it would be desirable to employ brittle high-modulus yarns, that is, elongated multifilamentary members formed of materials exhibiting high ratios of stress to strain, but exhibiting brittleness making them difficult to handle. Such materials include relatively well-known materials such as carbon fiber and fiberglass, and less common materials such as basalt, quartz, and boron. While these relatively brittle materials are used successfully in a variety of applications, their brittleness has prevented them from being used in certain manufacturing processes which are desirable.

In particular, there are many applications in which it is helpful to provide a yarn with a "tacky" (that is, somewhat adhesive) coating, so that the yarn can be disposed in a desired position against a substrate in manufacture of a product, followed by application of heat and pressure, securing the yarn in position for further processing.

For example, in manufacture of laminated products such as sails, yarns are laminated between opposing membranes. The opposed membranes are bonded to one another, encapsulating and capturing the yarns. The yarns then provide the required tensile strength, while the membranes provide airtightness. See, e.g., Conrad U.S. Pat. No. 4,708,080. This is a popular way to make sails, because the tensile strength characteristics of the sail can be tailored to the anticipated loads by careful disposition of the yarns.

However, due to the brittleness of the high-modulus materials mentioned, this process cannot be practiced as readily with these as with less brittle yarns; it would be desirable to adapt the high-modulus materials so that they could be used as are the less brittle (but lower modulus) yarns.

More specifically, as typically practiced, the manufacture of laminated sails is begun by disposing a panel of the membrane material (typically Mylar polyester) over a table shaped to the desired curvature of the sail. Alternatively, as discussed in the Conrad patent, the material can be laminated on flat tables, and "broadseamed", i.e., adjacent panels are joined along curved seams, to define the desired shape of the sail.

In either case, yarns of the desired material are disposed in desired patterns over the membrane, corresponding to the anticipated loads. Certain less brittle yarns, such as "Kevlar" aramid, can be provided with a tacky adhesive coating, so that when the yarns are urged into contact with the membrane, typically with a heated roller applying heat and pressure, they will hold their position. A second membrane of the desired material is then disposed over this assembly, and the whole laminated together, typically by application of heat and pressure. (Those of skill in the art will recognize that this is a very simplified description of the process, and in particular that various additional layers may be incorporated into the basic structure.)

However, certain brittle high-modulus materials that would be desirably used as yarns in the above process (and many other processes) cannot be treated as above. In particular, if yarns of the relatively brittle carbon fiber, fiberglass, basalt, quartz and/or other brittle inorganic materials are coated with a tacky adhesive and the yarn is wound onto a spool for shipment and subsequent processing, the adjacent strands of yarn on the spool will tend to bond to one another, a problem known as "blocking" in the industry.

More specifically, where sections of the yarn contact one another as they are wrapped around the spool, the tacky adhesive on the yarn tends to bond the juxtaposed sections to one another. Subsequently, as the yarn is paid off the spool, substantial force is exerted between individual filaments of the sections of the yarn in contact with one another; this force leads to an unacceptable degree of breakage of the brittle individual filaments and loss of strength of the yarn. To avoid this "blocking" problem, the multiple filaments making up yarns made of these brittle materials are typically adhered to one another (for stability in handling) by a coating of a drying, non-tacky adhesive. In order that the yarn can be secured in a desired position on the membrane, it is passed through a bath of a tacky adhesive just prior to being urged against the membrane with application of heat and pressure, which ensures that it will stay in place until the entire surface of the membrane has had yarns applied in the desired pattern. However, this additional processing step adds complexity, cost, and weight; it would be preferred to provide yarns of the desired high-modulus materials having a tacky coating to allow simpler processing.

Alternatively, the yarn can be coated first with a high-tack adhesive followed by a controlled layer of release agent; however, the amount of release agent must be controlled carefully to ensure that it does not interfere with formation of a high-integrity bond in the final product. More specifically, blocking can still present difficulty if insufficient release agent is applied, while the presence of excessive release agent adversely affects the ultimate bond. Accordingly, the release agent is desirably avoided completely.

One apparent solution to this problem would be to apply an adhesive coating to the yarn of a material that is not tacky until heat and pressure are applied, so as to avoid "blocking"; unfortunately, no suitably compatible adhesive is known. In particular, all known adhesives which do not tend to self-adhere, e.g., as a coated yarn is spooled, do not develop sufficiently strong bonds when heated and urged into contact with a substrate coated with a similar adhesive.

More specifically, a bond of great integrity is required between the yarns and the films, and the films to one another, to provide adequate service life to the sail. Applicant's testing indicates that polyester adhesive coatings are desirably applied to the films and to the yarns, although, as discussed below, they are preferably not the same polyester adhesive. More specifically, this testing indicates that the best bonding is achieved through use of a more tacky adhesive on the yarns, e.g., a "Vitel" co-polyester adhesive from Bostik Adhesives, and a non-tacky polyester adhesive on the films. However, use of the selected tacky Vitel adhesive on brittle yarns leads to the "blocking" problem. Other non-tacky adhesives can be used, e.g., low-tack ethylene vinyl acetate (EVA) can be used as the adhesive on the films and on the yarns, but this does not result in as strong a bond.

For similar reasons, brittle, high-modulus yarns often cannot be used as desired in various additional manufacturing processes involving one or more of weaving, knitting, braiding, filament winding, and laminating steps, or in manufacture of "laid-up" products, such as non-woven fabrics known as "scrims".

SUMMARY OF THE INVENTION

According to the present invention, multifilamentary "core" yarns of the desired brittle, high-modulus materials are partially encased in a "wrapper" of another material, typically a mono- or multi-filamentary binding of polyester, nylon, aramid, olefin, cotton, rayon or other low-cost material. In one successfully-tested embodiment, the wrapper was applied in both "S" and "Z" orientations, that is, both clockwise and counterclockwise around the core yarn. The wrapped yarn is then coated with an adhesive that remains tacky over time, preferably polyester; alternatives include low molecular weight, high tack ethylene vinyl acetate (EVA), polyamide, or other adhesives. The coated wrapped yarn can then be spooled and stored indefinitely; when it is desired to be used, the yarn can be pulled off the spool without damage to the brittle, high modulus core yarn. The tacky surface allows the yarn to be disposed where desired with respect to a substrate, typically having been coated with a compatible adhesive, and heat and pressure applied to ensure that the yarn will remain in position on the substrate. The presence of the wrapper prevents blocking in that intimate contact between the high-modulus filaments is largely avoided, and this in turn allows various processes previously not feasible with brittle, high-modulus multifilamentary yarns to be practiced.

BRIEF DESCRIPTION OF THE DRAWINGS

The invention will be better understood with reference to the accompanying drawings, in which.

DETAILED DESCRIPTION OF THE PREFERRED EMBODIMENTS

Figure 1:
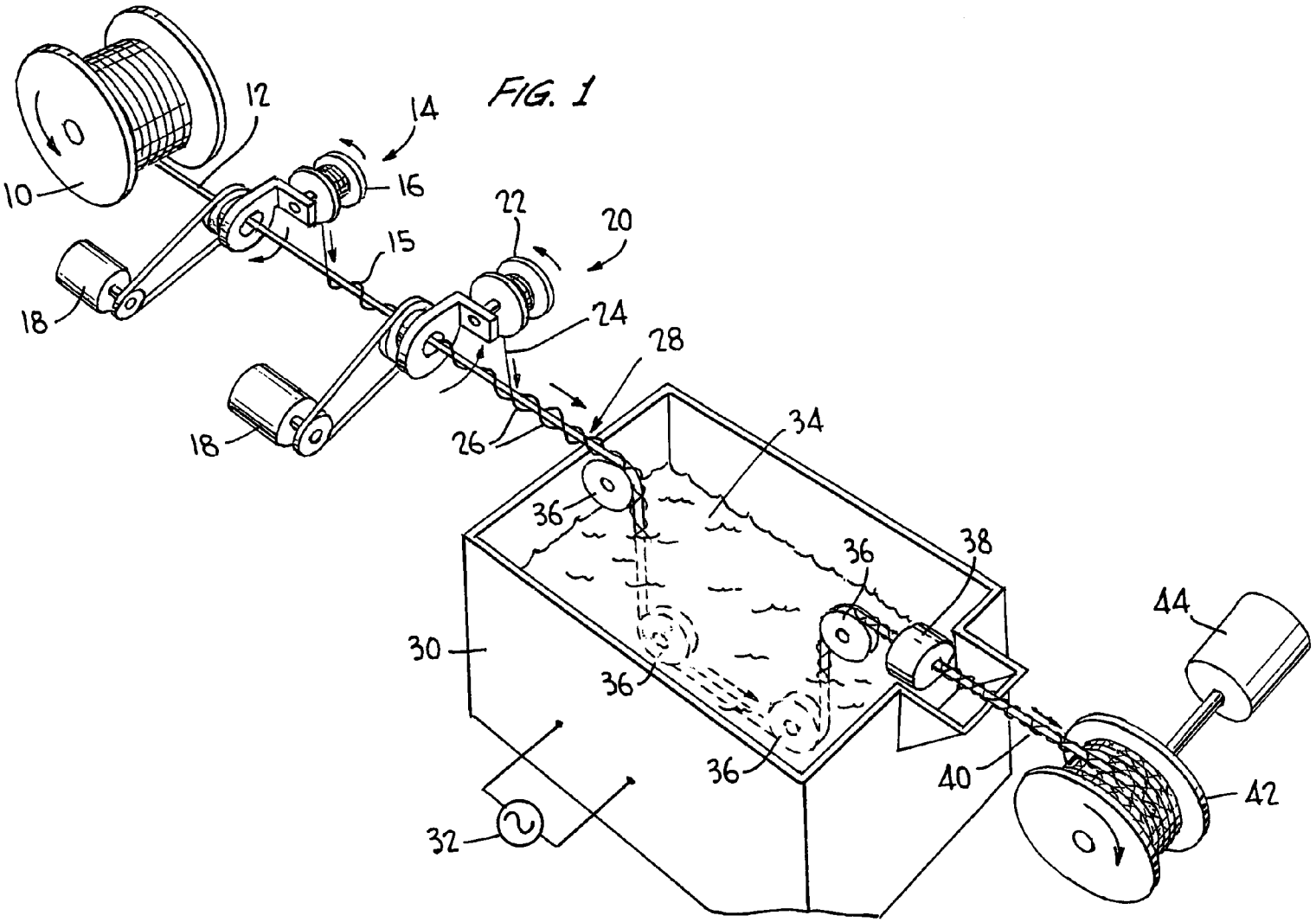
FIG. 1 is a schematic perspective view of the process of wrapping and adhesive-coating a multifilamentary yarn according to the invention.

As set forth above, according to the invention a multifilament core yarn made up of brittle, high modulus materials is first partially encased in a "wrapper", preferably comprising a mono- or multifilamentary material. The wrapped yarn is then coated with an adhesive which remains tacky over time, that is, which can be readily adhered to a substrate or other component by application of heat and pressure. The wrapper provides protection for the brittle, high-modulus core yarn, allowing the yarn to be spooled for shipment and further processing without "blocking", that is, adhesion of the filaments of the yarns to one another. This in turn reduces or eliminates breakage of the brittle filaments of the yarn upon unspooling and further handling. FIG. 1 shows schematically the principal components of equipment for so processing yarns.

A core yarn to be processed according to the invention is paid off a supply spool 10. As noted above, the invention is of particular interest in allowing convenient processing of brittle, high-modulus multifilament yarns, such as those of fiberglass, basalt, or carbon fiber. According to the invention, the core yarn 12 passes through at least one winder assembly 14. As is generally conventional in the art, winder assembly 14 comprises a spool 16 from which a strand 15 of a desired wrapper material, typically a low-modulus, non-brittle mono- or multifilamentary polyester, nylon, aramid, olefin, cotton, rayon, or another less brittle material, or a combination thereof, is dispensed. Spool 16 is driven for rotation around the yarn as the yarn passes by winder assembly 14, so that the strand 15 of wrapper material is applied spirally around the yarn 12. FIG. 1 shows the spool 16 being rotated around yarn 12 by a motor 18; the art is well aware of equipment for the purpose. A second similar winding assembly 20 may be provided, with the spool thereof 22 driven in the opposite direction to spool 16, so that a second strand 24 of the same or a different desired wrapper material is applied, but wrapped in the opposite direction.

After application, the strands of wrapper material, which may be further multiplied if desired, are referred to simply as the wrapper 26. The rate of rotation of spools 16 and 22 relative to the speed of passage of the core yarn 12 controls the degree to which the strands 15 and 24 of the wrapper 26 encase the core yarn 12; coverage of between about 10% and about 75% of the total surface area is considered appropriate.

In particular, the core yarn 12 should not be completely encased by the wrapper 26, so that the filaments of the core yarn can later be bonded directly to another material, to ensure that the tensile properties of the filaments are effectively realized in the final product. This sets an upper bound for the degree of encasement of the core yarn 12 by the wrapper 26; the lower bound is set by the requirement that the wrapper encase the core yarn 12 sufficiently to avoid blocking, thus avoiding damage to the filaments of the core yarn 12. The degree of encasement desired in any particular application will vary in accordance with the length of the filaments of the core yarn, their material, the number of filaments of the core yarn, and other factors apparent to those of skill in the art.

After encasement by the wrapper 26, a coating of a tacky adhesive is applied to the wrapped yarn 28. In the preferred embodiment, this is accomplished by passing the wrapped yarn 28 through a bath 34 of a hot-melt adhesive. The adhesive could alternatively be applied by extrusion, spraying, or in a room-temperature bath. Suitable hot-melt adhesives include ethylene vinyl acetate (EVA), polyamides, polyesters, and other materials known to the art, chosen for compatibility with the adhesive used on the substrate to which the yarn will be applied, e.g. a film making up one surface of a sail, or a mandrel for filament winding, as discussed below. As noted above, where the yarn is to be applied to a film in sailmaking, the film having been coated with a non-tacky polyester adhesive, the adhesive applied to the core yarn is preferably "Vitel" co-polyester adhesive from Bostik Adhesives. Application can be readily accomplished as illustrated schematically in FIG. 1. The desired adhesive 34 is disposed in a tank 30, heated as indicated at 32 to a desired temperature. The wrapped yarn is passed over a series of rollers 36 and through a die 38. Die 38 removes excess adhesive and ensures that the wrapped, coated yarn 40 is uniformly coated, for convenience in use. Die 38 may be a simple aperture in a die block, or may be a multi-roller assembly. The latter might be particularly desirable if a tape-like yarn is to be made, as might be desirable in laminated products, such as sails, to provide a flat outer surface. After drying, either in air or in a water bath, the wrapped, coated yarn is then wound on a spool 42 driven by a motor 44.

The amount of adhesive coating applied to the wrapped yarn 28, and the degree to which it penetrates the multifilamentary yarn, is important in achieving desired characteristics in the final product. Specifically, it is not desirable that the adhesive penetrate the yarn substantially beyond its surface, since that would effectively bond the filaments to one another, rendering the yarn inflexible and likely to fracture in use. Accordingly, saturation of the yarn by adhesive is to be avoided. If a hot-melt adhesive such as the Vitel material is used, control of the temperature of the bath is important in maintaining the adhesive sufficiently viscous that it does not saturate the yarn but forms a coating, as desired. The size of the die aperture relative to the diameter of the wrapped yarn is also significant in ensuring that the desired amount of adhesive is applied. Between about 20% and about 90% by weight of the final coated, wrapped yarn may be adhesive, depending on the amount of tackiness desired, and the degree to which the adhesive coating is to contribute to the integrity of the product to be manufactured using the yarn of the invention. Experimentation to select desired materials and to determine optimal values for various process variables responsive to specific applications is within the skill of the art.

Figure 2A:
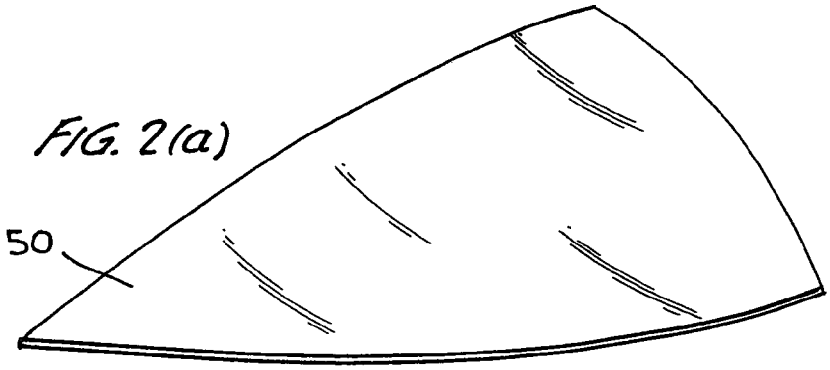
FIG. 2, comprising FIGS. 2(*a*)-2(*c*), is a series of schematic perspective views showing stages in the manufacture of a laminated sail according to the invention.
Figure 2B:
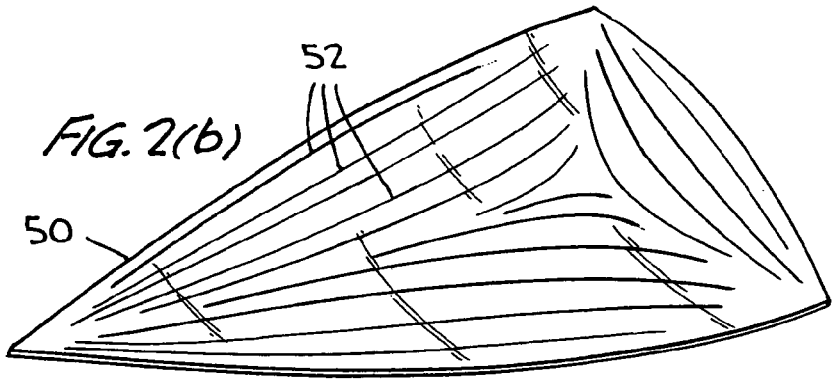
Figure 2C:
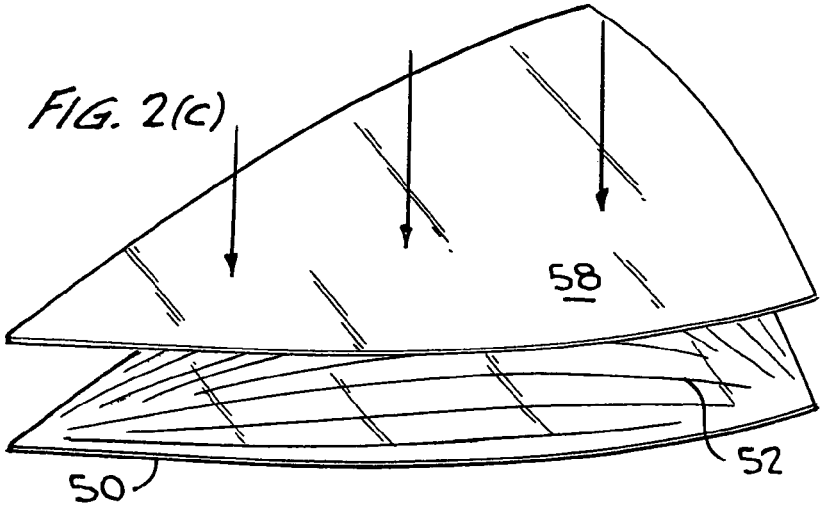

FIG. 2, comprising FIGS. 2(*a*)-2(*c*), is a series of schematic perspective views showing stages in the manufacture of a laminated sail according to the invention. The process itself is essentially similar to known processes, except that yarns manufactured according to the invention are employed. In FIG. 2(*a*), a first panel 50 of a desired membrane material, typically a Mylar or other polyester film coated on one side with a non-tacky polyester adhesive, is cut out in a desired shape and placed over a table, the surface of which conforms to the desired curvature of the sail. (As noted, in a closely related process also within the scope of the invention the sail is built up of panels which are laminated flat; curvature is built into the sail by "broadseaming", i.e., joining the panels along curved seams.) In FIG. 2(*b*), wrapped, coated yarns 52 according to the invention are placed on panel 50 in positions selected in accordance with the anticipated tensile loads on the sail, that is, the yarns are aligned so that they effectively strengthen the material of the membrane in the direction of the loads. As mentioned above, in this application it may be desirable to form the yarn as a flat tape, so that the surface of the sail is as smooth as possible.

Figure 3:
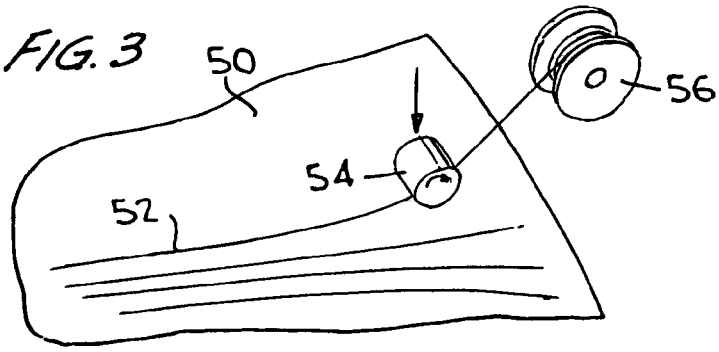
FIG. 3 is a detail showing the application of a yarn processed according to the invention to a membrane, as part of the process of FIG. 2.

As illustrated in further detail by FIG. 3, as the yarn 52 is dispensed from a spool 56, it is pressed into contact with the membrane 50 by a heated roller 54 or the like; the heat and pressure effectively activate the tacky coating on the yarn, so that it adheres to the membrane, and so that the yarns remain in their desired positions against the substrate provided by the membrane during the remaining manufacturing steps. As shown in FIG. 2(*c*), these steps will typically include preparation of a second panel 58 of the desired membrane material, similarly coated with a compatible adhesive. Second panel 58 is aligned with panel 50 and pressed thereagainst, e.g., by application of heated rollers, by vacuum bagging with application of heat, or other known techniques, to ensure that a good bond is formed between the panels 50 and 58 and between the panels and the yarns, encapsulating the yarns in their desired positions between the panels, and efficiently transferring the loads from the panels to the yarns.

The art will recognize that there are numerous other and alternative steps involved in manufacturing laminated sails, and that various additional materials are commonly also incorporated. The above greatly simplified description of the process is not to be taken to limit the invention.

The art will further recognize that the wrapped, coated high-modulus yarns of the invention, being much more readily handled than prior high-modulus yarns, will be useful in numerous additional processes for the manufacture of a wide variety of products. In general, the yarns of the invention can be employed in all manner of processes in which yarns of lower-modulus, less brittle materials, coated with a tacky adhesive for processing convenience, have heretofore been used, with a concomitant improvement in properties due to the use of the stronger high-modulus yarns. Such processes include, without limitation, lamination, as discussed in detail above, braiding, knitting, weaving, filament-winding, "laying-up" processes, and combinations thereof.

Figure 4:
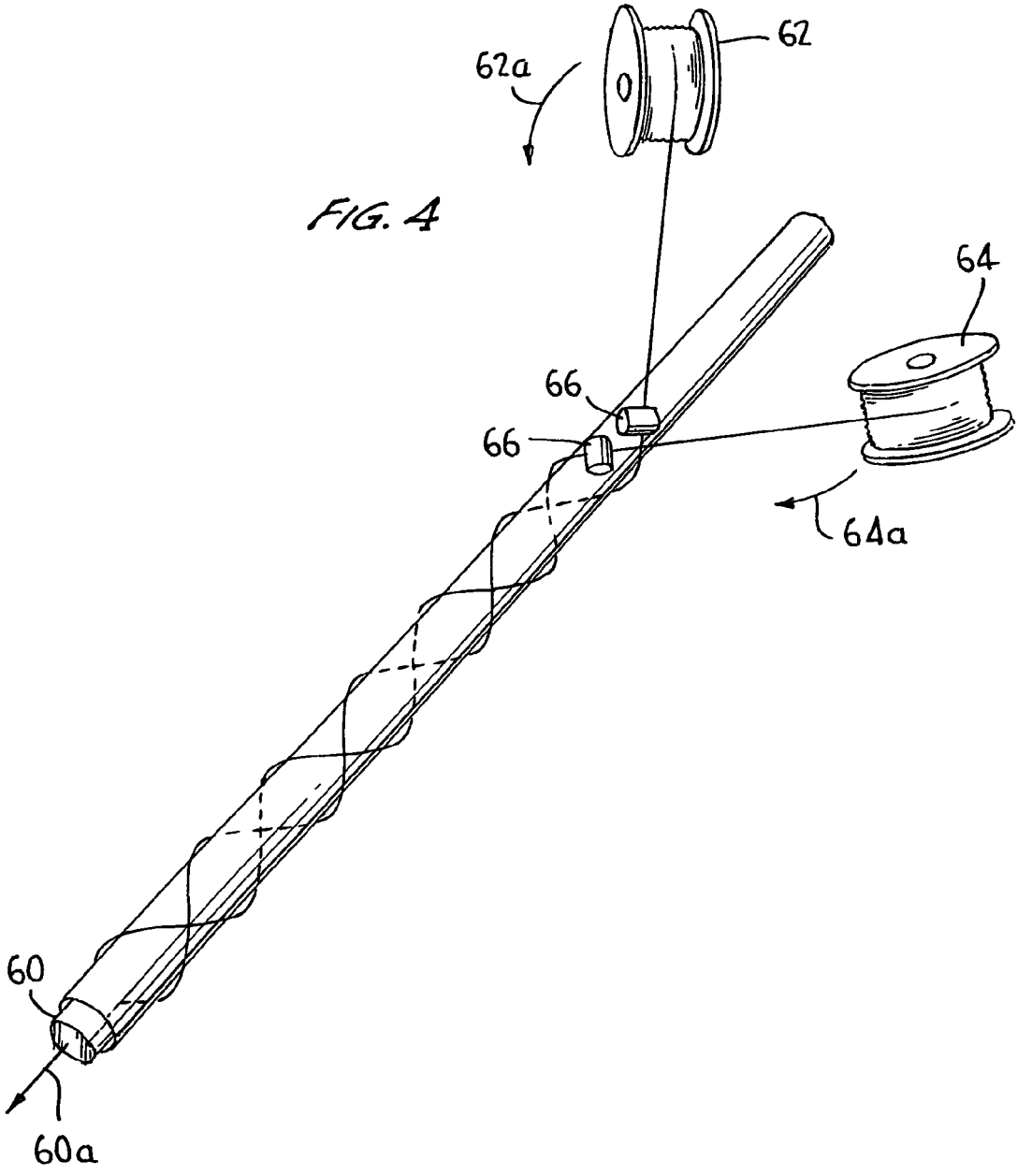
FIG. 4 is a schematic perspective view illustrating a filament winding process employing the yarns of the invention.

FIG. 4 provides a schematic illustration of a filament-winding process practiced according to the invention. In the example, an elongated member, such as a mast, is to be produced. A central member 60, which may be a removable mandrel or a component of the completed product, is to be wrapped helically with a large number of wrapped-coated yarns of high-modulus material according to the invention. Spools 62 and 64 of the yarn are rotated in opposite directions around member 60, as indicated by arrows 62*a* and 64*a*, while member 60*a* is moved axially with respect to the spools 62 and 64, as indicated by arrow 60*a*. Heated rollers 66 are provided to press the yarns into contact with the central member and underlying layers of yarn; the tacky coating provided according to the invention allows the yarns to be thus temporarily secured in position with respect to the substrate. This process could be repeated many times, with the yarns aligned at various directions to the axis of elongation of the central member 60, depending on the precise characteristics desired in the final product. When all the yarns have thus been placed, the entire assembly may be finally cured, e.g., by vacuum-bagging and application of heat. Again, the art will recognize that this is a very simplified description of such a process, and will realize that various alternative arrangements may be preferred; all these are considered within the scope of the invention.

Testing was performed to compare an uncoated, unwrapped virgin core yarn to the wrapped, coated yarn according to the invention, and, for completeness, to the core yarns simply wrapped without adhesive coating. Comparable tests were performed using both carbon fiber and fiber glass yarns. The carbon fiber core yarn used in a first series of tests was a Toray 24K yarn, comprising approximately 24,000 filaments, having a total denier of 15,376. The fiberglass yarn was Advanced Glass Yarns Type 449-AA-1250, having a total denier of 3,630. The wrapped samples had two oppositely-handed multifilamentary strands of 210 to 300 denier polyester material applied thereto, with the pitch of the twisting varied between 4, 8, and 10 revolutions or "wraps" per inch ("wpi"), such that coverage of approximately 10-50% of the surface of the yarn was achieved. The coating applied was a co-polyester based Vitel adhesive, applied in a bath maintained at a temperature of 460 degrees F., in which the yarn spent approximately one second residence time. The yarn was air-cooled after application. The die had an aperture of 0.031", so that a coating averaging 24% by weight of the coated yarn was applied. This product did not exhibit blocking after spooling and was readily handled.

Test results as to the Toray 24K carbon fiber material (showing the average of six or more tests of each material) were as follows:

Raw Carbon (uncoated, prior to wrapping) Ave. Modulus: 202.96 g/d (grams/denier), Ave. Load: 8.21 g/d, Ave. Elongation: 2.61%, Ave. Denier: 15,376.64.

Carbon wrapped with 4 wpi of polyester as above: Ave. Modulus: 329.71 g/d, Ave. Load: 11.9 g/d, Ave. Elongation: 1.18%, Ave. Denier: 15,448.80.

Carbon wrapped with 8 wpi of polyester as above: Ave. Modulus: 371.46 g/d, Ave. Load: 14.6 g/d, Ave. Elongation: 1.22%, Ave. Denier: 15,799.76.

Carbon wrapped with 10 wpi of polyester as above: Ave. Modulus: 379.31 g/d, Ave. Load: 14.33 g/d, Ave. Elongation: 1.26%, Ave. Denier: 15,967.04.

Carbon wrapped with 4 wpi of polyester as above, and coated as above: Ave. Modulus: 195.66 g/d, Ave. Load: 11.7 g/d, Ave. Elongation: 1.62%, Ave. Denier: 20,381.92.

Carbon wrapped with 8 wpi of polyester as above, and coated as above: Ave. Modulus: 188.73 g/d, Ave. Load: 10.77 g/d, Ave. Elongation: 1.71%, Ave. Denier: 20,916.56.

Carbon wrapped with 10 wpi of polyester as above, and coated as above: Ave. Modulus: 176.38 g/d, Ave. Load: 11.1 g/d, Ave. Elongation: 1.58%, Ave. Denier: 20,992.00.

Test results as to the Advanced Glass Yarns Type 449-11-1250 fiberglass material (showing the average of six or more tests of each material) were as follows:

Raw Fiberglass: Ave. Modulus: 164.35 g/d, Ave. Load: 9.5 g/d, Ave. Elongation: 0.93%, Ave. Denier: 3,630.96.

Fiberglass wrapped with 4 wpi of polyester as above: Ave. Modulus: 130.69 g/d, Ave. Load: 9.44 g/d, Ave. Elongation: 0.97%, Ave. Denier: 4,300.

Fiberglass wrapped with 8 wpi of polyester as above: Ave. Modulus: 120.29 g/d, Ave. Load: 10.25 g/d, Ave. Elongation: 0.99%, Ave. Denier: 4,346.

Fiberglass wrapped with 10 wpi of polyester as above: Ave. Modulus: 116.90 g/d, Ave. Load: 10.16 g/d, Ave. Elongation: 1.01%, Ave. Denier: 4,428.

Fiberglass wrapped with 4 wpi of polyester as above, and coated as above: Ave. Modulus: 72.07 g/d, Ave. Load: 7.30 g/d, Ave. Elongation: 1.15%, Ave. Denier: 5,818.70.

Fiberglass wrapped with 8 wpi of polyester as above, and coated as above: Ave. Modulus: 66.9 g/d, Ave. Load: 7.59 g/d, Ave. Elongation: 1.15%, Ave. Denier: 5,730.16.

Fiberglass wrapped with 10 wpi of polyester as above, and coated as above: Ave. Modulus: 63.90 g/d, Ave. Load: 7.87 g/d, Ave. Elongation: 1.14%, Ave. Denier: 5,894.16.

Thus, it can be seen that the provision of the wrapper and coating did not significantly damage or reduce the useful properties of the yarns; more specifically, the reduction in modulus and elongation values noted in the above results corresponding to the wrapping and coating steps are essentially proportional to the additional weight of the wrapper and coatings applied. Given that processing according to the invention renders these yarns useful in applications where they could not be used previously, a substantial improvement is provided by the invention.

While preferred embodiments of the method of making of the yarns of the invention, of the yarns so made, processes for manufacturing various products using the yarns so made, and the products so made have been disclosed, those of skill in the art will recognize that various changes could be made thereto, in particular in the manner of using the yarns of the invention to manufacture a wide variety of products, without departure from the spirit and scope of the invention. Accordingly, the invention is not to be limited by the specific disclosure made above, but only by the following claims.

What is claimed is:

1. A process for producing a high-modulus yarn having improved handling characteristics, comprising the steps of:

providing a core yarn consisting of a large number of filaments of a high-modulus, brittle material;

partially encasing said core yarn in a wrapper comprising at least one strand of a lower-modulus, less brittle material, such that between about 10% and about 75% of the surface of said core yarn is concealed beneath said wrapper; and coating the wrapped core yarn with an adhesive that remains tacky over time, such that the coated wrapped yarn may be caused to remain in a desired position against a suitable substrate by being pressed thereagainst with application of heat, said coating step being performed such that said adhesive does not entirely saturate the filaments of the core yarn, but forms a coating on the outer surface of the wrapped core yarn, whereby the inner filaments of the core are not adhesively bonded to one another and said coated wrapped yarn can be bent without fracture of the filaments of the core yarn.

2. The process of claim 1, wherein said high-modulus, brittle material is selected from the group consisting of carbon fiber, fiberglass, and basalt fibers.

3. The process of claim 1, wherein said adhesive that remains tacky over time is selected from the group consisting of ethylene vinyl acetate (EVA), polyamides, and polyesters.

4. The process of claim 3, wherein said adhesive is applied by passing the wrapped yarn through a heated bath of the desired adhesive.

5. The process of claim 1, wherein said lower-modulus, less brittle material of said wrapper is selected from the group consisting of mono- or multifilamentary polyesters, nylons, aramids, olefins, rayons, or cottons, and combinations thereof.

* * * * *